United States Patent [19]

Adams, III et al.

[11] Patent Number: 4,986,769

[45] Date of Patent: Jan. 22, 1991

[54] POLARIZATION AND KEYING MECHANISM

[75] Inventors: Charles N. Adams, III, Harrisburg; Leroy J. Morningstar, Middletown, both of Pa.

[73] Assignee: AMP Incorporated, Harrisburg, Pa.

[21] Appl. No.: 438,285

[22] Filed: Nov. 16, 1989

[51] Int. Cl.[5] ..... H01R 13/64

[52] U.S. Cl. ..... 439/681; 439/347; 439/368

[58] Field of Search ..... 439/677, 678, 679, 680, 439/681, 325, 327, 345, 347, 368, 564, 565, 569, 573

[56] References Cited

U.S. PATENT DOCUMENTS

| | | | |
|---|---|---|---|
| 4,181,391 | 1/1980 | Kilsdonk | 439/679 X |
| 4,332,432 | 6/1982 | Colleran | 439/347 |
| 4,579,412 | 4/1986 | Czeschka et al. | 439/680 X |
| 4,620,759 | 11/1986 | Vetter | 439/680 X |
| 4,781,626 | 11/1988 | Lazarchik | 439/680 |
| 4,838,807 | 6/1989 | Takinori et al. | 439/347 |
| 4,875,877 | 10/1989 | Fleak et al. | 439/497 |
| 4,880,392 | 11/1989 | Schieferly | 439/347 |

FOREIGN PATENT DOCUMENTS

| | | | |
|---|---|---|---|
| 2035721 | 6/1980 | United Kingdom | 439/681 |

*Primary Examiner*—Neil Abrams
*Assistant Examiner*—Khiem Nguyen
*Attorney, Agent, or Firm*—Gerald K. Kita

[57] ABSTRACT

A first connector 1 provided with a polarizing structure 23 and keying structure 28, 29, a complementary housing 3 provided with a receiving end 25 having a slidable frame 30 for receiving the polarizing structure 23 and the keying structure 28, 29, and the frame 30 having complementary keying means aligned with the keying structure of the first connector and aligned with a single one of the multiple connector positions.

12 Claims, 4 Drawing Sheets

POLARIZATION AND KEYING MECHANISM

The field of the invention is a polarization and keying mechanism for electrical connectors, and more particularly, to a polarization and keying mechanism for multiple connectors in a single header.

There is known from U.S. Pat. No. 4,781,626, a first connector provided With a polarizing structure and keying structure, a complementary housing larger than the first connector is provided with a receiving end defined by complementary polarizing means for receiving the polarizing structure of the first connector, and the complementary housing includes complementary keying means receiving the keying structure of the first connector.

According to the invention, a first connector is provided with a keying structure and a polarizing structure, a complementary connector larger than the first connector is provided with a receiving end having multiple connector positions each defined by complementary polarizing means for receiving the polarizing structure of the first connector, and the complementary housing includes a frame on the receiving end having complementary keying means receiving the keying structure of the first connector in alignment with one of the multiple connector positions.

The advantage is that the frame is an interchangeable part suitable for interchange with other frames provided with different complementary keying means.

Further according to the invention, the frame is slidable along the receiving end of the complementary housing and overlaps the polarizing means and the keying structure of the first connector to prevent withdrawal from the complementary housing.

Further according to the invention, movement of the frame along the receiving end of the complementary housing is limited to become aligned with only one of the multiple connector positions.

The invention will now be described by way of example with reference to the accompanying drawings.

In the drawings, FIG. 1 is a perspective view of a first connector and a complementary housing FIG. 2 is a top plan view of the complementary housing with multiple first connectors.

Figure 1:
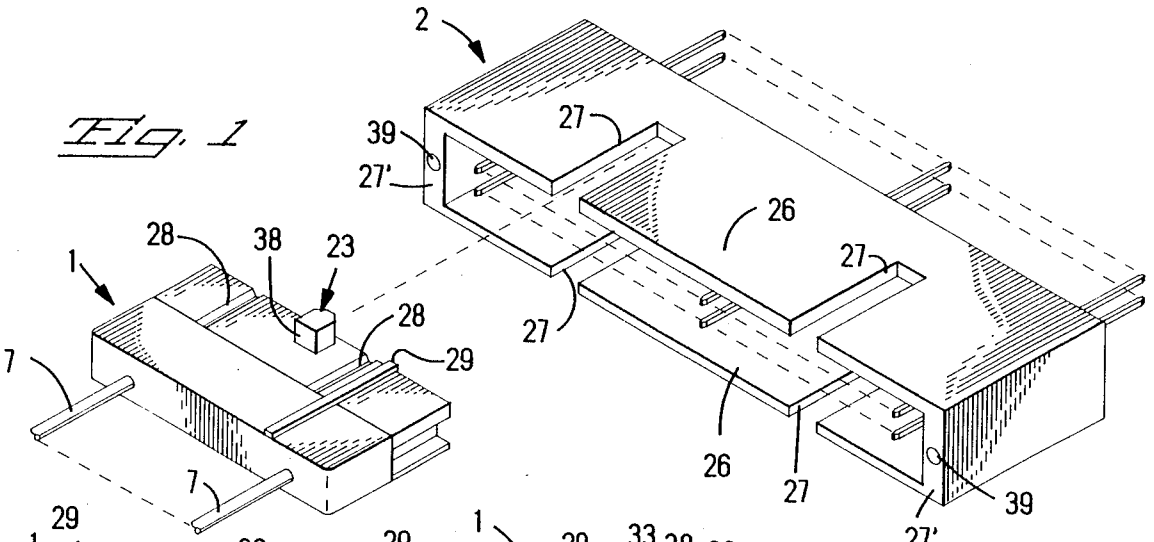
Figure 2:
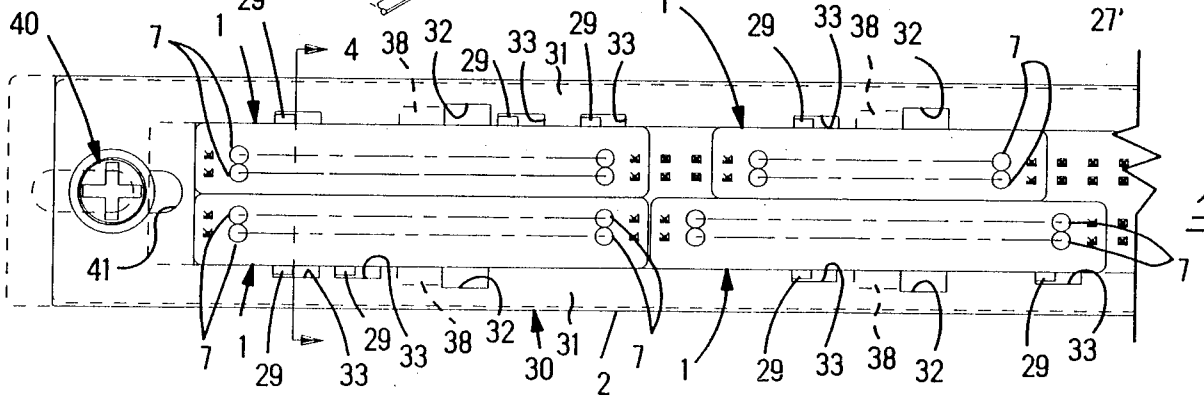
Figure 4:
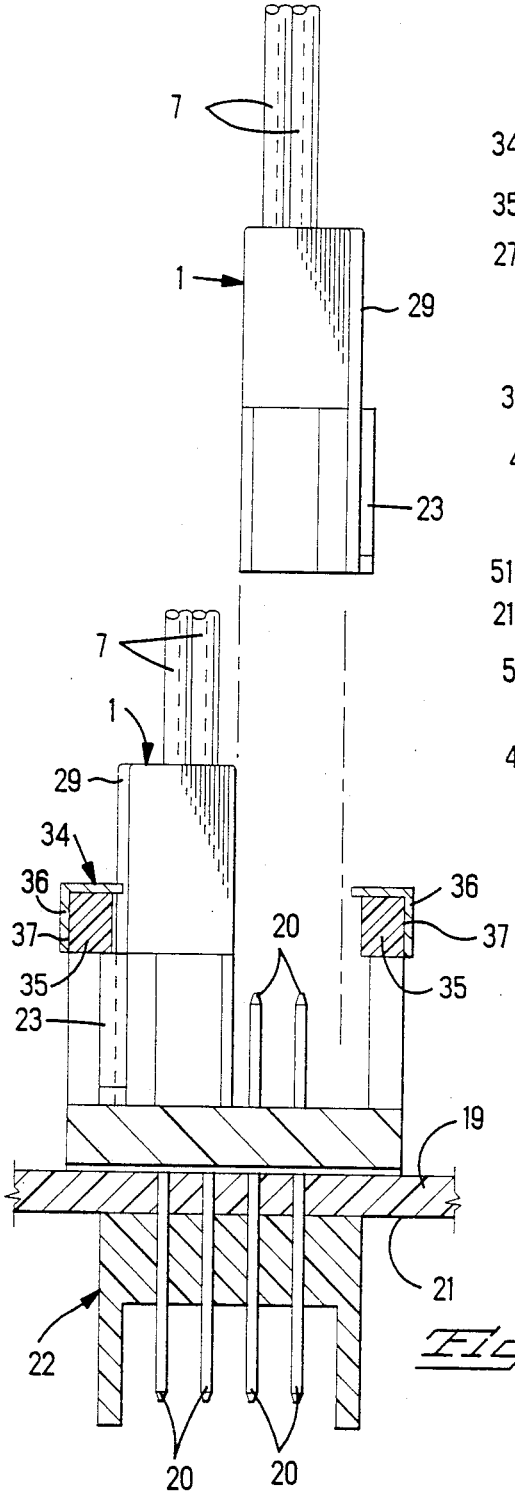
FIG. 4 is a section view taken along the line 4—4 of FIG. 2 and further illustrating one of the multiple first connectors exploded from the complementary housing.
Figure 6:
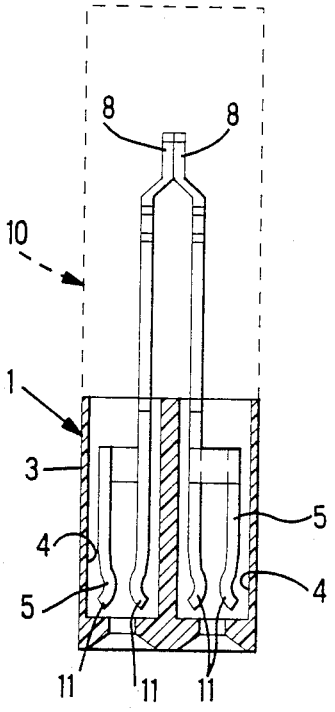
FIG. 6 is a section view taken along the line 6!3 6 of FIG. 3.
Figure 7:
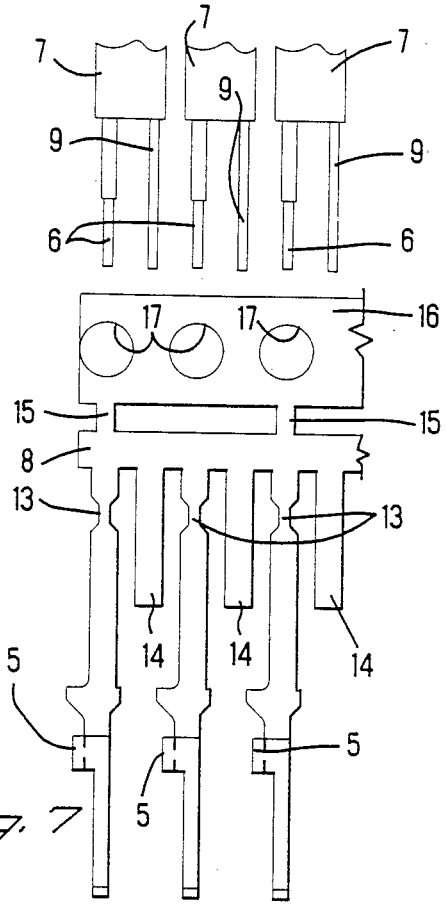
FIG. 7 is a plan view of electrical contacts of the connector shown in FIG. 3.
Figure 8:
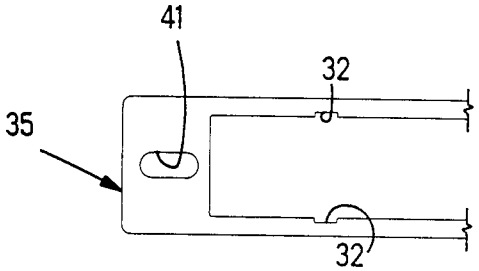
FIG. 8 is a fragmentary plan view of a portion of a frame.
Figure 9:
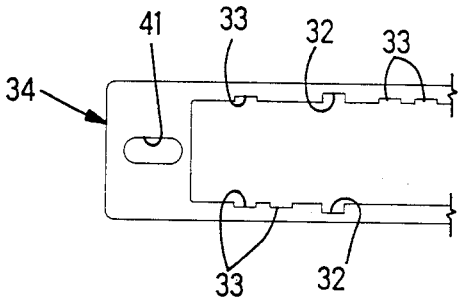
FIG. 9 is a fragmentary plan view of another portion of a frame.

With reference to FIGS. 1, 2 and 4, a number of individual electrical connectors 1 are shown connected with a complementary housing 2. In FIGS. 1, 6 and 7, each connector 1 includes an insulative housing 3 having contact receiving cavities 4, conductive contacts 5 in corresponding cavities 4, at least one signal wire 6 of at least one electrical cable 7 connected to corresponding signal contacts 5, a reference conductor 8, such as a ground bus, connected to corresponding ground or reference wires 9 of the cable 7, and a cable strain relief 10 attached to the cable 7 and the housing 3.

FIGS. 6 and 7 show a front of each of the corresponding contacts 5 includes opposed resilient fingers 11 defining a receptacle type, electrical contact 5. Further, the corresponding contacts 5 include, wire connecting portions 12, and severable portions 13 connected to the reference conductor 8. Between corresponding contacts 5 are wire connecting portions 14 of the reference conductor 8. Removable stems 15 connect the reference conductor 8 to a removable carrier strip 16 having pilot holes 17. As disclosed in U.S. Pat. No. 4,875,877 issuing on application No. 243,385, filed, Sept. 12, 1988, the signal wires 6 and ground or reference wires 9 are connected with corresponding wire connecting portions 12, 14, for example, by welding or soldering, and each signal contact 5 can be detached from the reference conductor 8 or ground bus by severing the corresponding severable portion 13. Each selected signal contact 5 that remains joined to the reference conductor 8 becomes a contact 5 for connection to reference electrical potential or ground electrical potential.

After the signal wires 6 and ground or reference wires 9 have been connected, the strain relief 10 is assembled, for example, the strain relief 10 can be an insulative plastics material injection molded to engage the cable 7 and cover the wire connecting portions 12, 14. The material adheres and thereby is secured to the housing 3. Other devices may comprise a strain relief 10, such as clamps as disclosed in the Patent referred to above.

Figure 5:
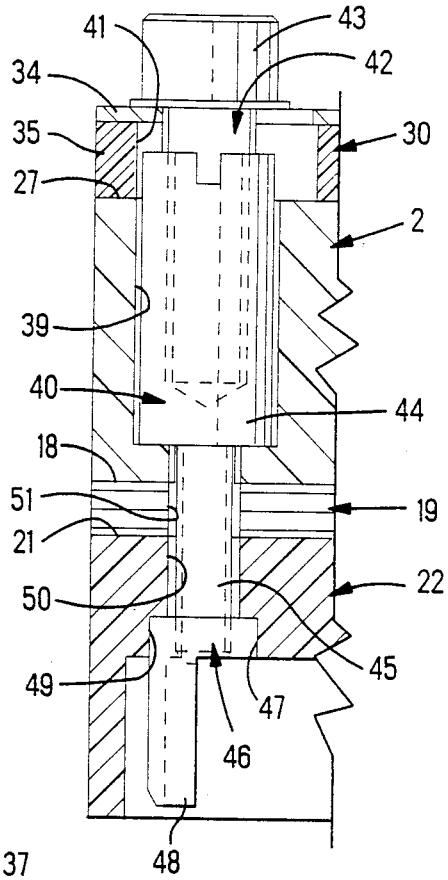
FIG. 5 is a fragmentary section view of a part of the complementary housing taken along the line 5—5 of FIG. 3.

As shown in FIGS. 4 and 5, the complementary housing 2 is mounted on a surface 18 of a printed circuit board, PCB, 19 encircling spaced apart, electrical contacts 20 in the form of pins projecting through opposite surfaces 18, 21 of the PCB. On the surface 21 of the PCB is an insulative header 22 encircling the pins or contacts 20. Each connector 1 is positioned by the complementary housing 2 in alignment with a corresponding group of pins or contacts 20 such that the signal contacts 5 and reference contacts 5 engage respective pins or contacts 20, and establish electrical connections of the pins or contacts 20 with corresponding signal wires 6 and reference wires 9.

With reference to FIGS. 1 and 2, the housing 3 of each connector 1 has a polarizing structure constructed of a projecting, polarizing key 23. For example, the key 23 can be molded from a plastics material and molded unitary with the housing 3. With reference to FIG. 1, the complementary housing 2 is constructed to receive each connector 1 in one of a number of positions. The complementary housing 2 is insulative and includes a cavity 24 in a connector receiving end 25 and defined between opposite side walls 26 and opposing end walls 27 connected to the side walls 26. The complementary housing 2 and the cavity 24 are longer than the connectors 1 to be received in the receiving end 25.

The receiving end 25 is provided with a series of spaced apart polarizing slots 27, each extending from the receiving end 25 and along an interior surface of a corresponding side wall 26 FIG. 1 shows each of the polarizing slots 27 extending through the exterior of the side walls 26. The polarizing key 23 of the connector 1 is received along a corresponding one of the polarizing slots 27 to position the connector 1 against a corresponding side wall 26 and in one of a number of connector positions located by corresponding polarizing slots 27. A width of the cavity 24 in the complementary housing 2 is larger than the combined width of two connectors 1 between the side walls 26, but less than the combined width of two connectors 1 and one polarizing key 23. Thus two connectors 1 will fit within the width of the cavity 24 with the polarizing keys 23 of the connectors 1 facing the side walls 26 and received along the polarizing slots 27.

As shown in FIG. 2, the connector 1 is positioned against one of the side walls 26, and is spaced away from the opposite one of side walls 26 against which another connector 1 is positioned. Four connectors 1 are in positions located by the corresponding polarizing keys 23 and polarizing slots 27. Not all the connectors 1 have the same length. It is difficult to locate connectors 1 of varied length along the complementary housing 2. A feature of the invention is that the polarizing key 23 in a corresponding polarizing slot 27 will locate connectors 1 of different lengths in correct position with respect to a complementary housing 2 of longer length than each of the connectors 1. The polarizing key 23 of each connector 1 is in the middle of the length of the connector 1 to locate the connector 1 in position with a corresponding polarizing slot 27 located along the length of the complementary housing 2.

Figure 3:
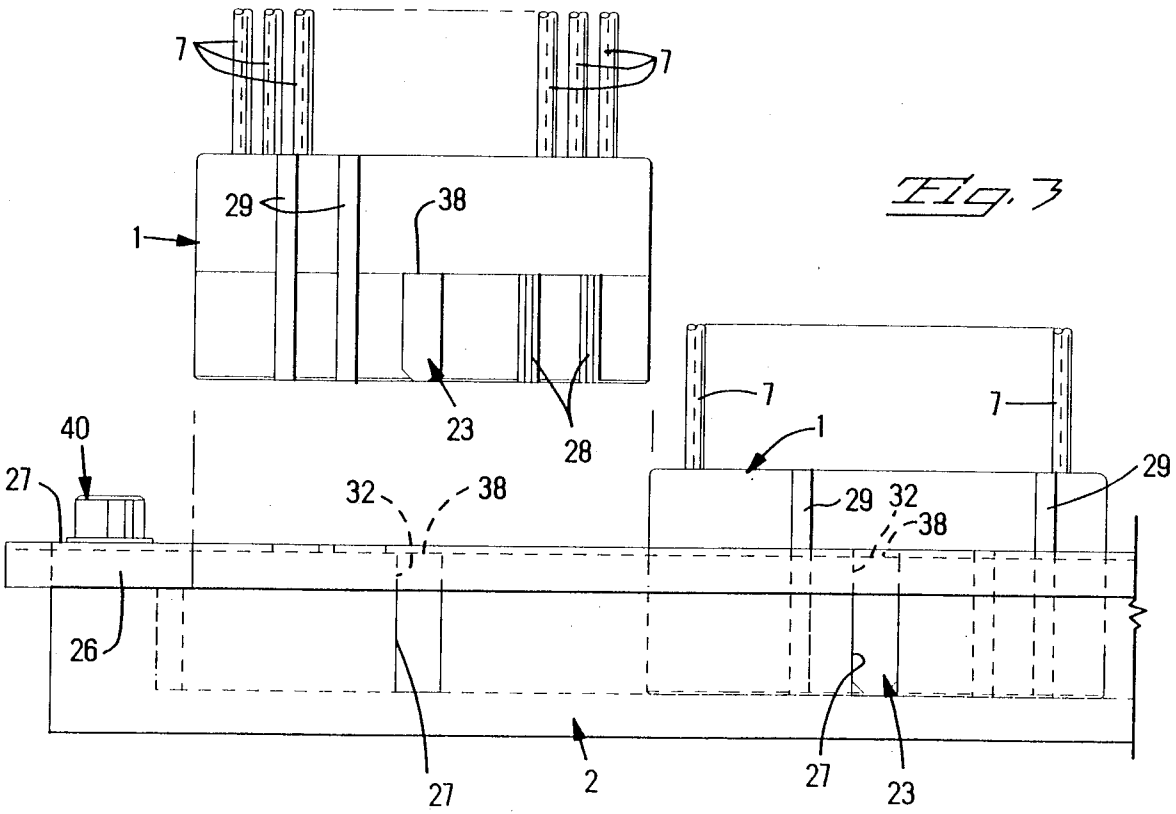
FIG. 3 is a fragmentary elevation view of the complementary housing shown in FIG. 2 together with one of the multiple first connectors exploded from the complementary housing.

With reference to FIGS. 1 and 3, the housing 3 has a keying structure 28 constructed of a series of spaced apart keying channels 28 in the exterior of the housing 3 along which are selectively located, projecting corresponding keys 29. The number of keys 29 can be varied for each connector 1, and the location of each key 29 can be varied for each connector 1, to provide a keying combination that distinguishes each connector 1 from the other connectors 1. For example, each key 29 can be plastics material that is injection molded in place to adhere to and thereby secure to an exterior of the housing 3. Further, for example, the plastics material of each key 29 may extend along the strain relief 10, and can be molded simultaneously with the strain relief 10.

With reference to FIGS. 2, 4, 5, 8 and 9, a frame 30, in the form of a bezel, for example, has opposing sides 31 overlying the receiving end 25 of the complementary housing 2 Each of the sides 31 is provided with polarizing openings 32 and groups of spaced apart keying openings 33 Each group of keying openings 33 is located on the corresponding side 31 and accompanies a corresponding polarizing opening 32. Each polarizing opening 32 defines a corresponding position for a connector 1 in the complementary housing 2 The keying openings 33 of each group vary in number and spacing apart and according to a combination that will match a combination of keys 29 on a corresponding connector 1. Each combination of keying openings 33 limit admission of a connector 1 into the complementary housing 2 to that connector 1 that has the matching combination of keys 29 that will pass along the matching combination of keying openings 33.

The keying openings 33 are provided on an interchangeable portion 34 of the frame 30 that is separate from a second portion 35, or locking portion, of the frame 30. Numerous interchangeable portions 34 can be fabricated, each having a combination of keying openings 33 that differ from combinations of keying openings 33 of other interchangeable portions 34. Each interchangeable portion 34 is fabricated at low cost by stamping a flat metal sheet. Bent over edges 36, FIGS. 3 and 4, of the interchangeable portion 34 overlap edges 37 of the second portion 35 of the frame 30 to lock the portions 34 and 35 together as a unit.

The frame 30 is slidable from a first position, FIG. 3, admitting various connectors 1 along the complementary housing 2, to a second position, FIG. 2, locking the connectors 1 in position along the complementary housing 2. The frame 30 in the first position, FIG. 3, aligns the polarizing openings 32 of the frame 30 with the polarizing slots 27 of the complementary housing 2. Together the polarizing slots 27 and the polarizing openings 32 comprise polarizing means for receiving the polarizing structure of any one of the connectors 1. The polarizing keys 23 of the connectors 1 pass through the polarizing openings 32 and are inserted along the polarizing slots 27. The frame 30 is then moved to the second position, FIG. 2, such that the frame 30 is moved to displace the polarizing openings 32 out of alignment with the polarizing keys 23 and the polarizing slots 27, and to overlap a rear end 38 of each polarizing key 23 and to latch the connector 1 in place and to prevent withdrawal of the corresponding connector 1. The rear end 38 of each polarizing key 23 projects further outward from the corresponding housing 3 than the keys 29. Each of the keying openings 33 in the interchangeable portion 34 of the frame 30 is longer than the width of a corresponding key 29 received in the keying opening 33. This feature permits the keying openings 33 to move relative to the keys 29 when the frame 30 is moved to the second position, and the keys 29 to move along the keying openings 33 as the frame 30 is moved. The ends of the keying openings 33 provide stops to engage against corresponding keys 29 and to limit the length of movement of the frame 30.

The complementary housing 2 has a passage 39 extending in each end wall 27,, FIG. 1. In each passage 39 extends a multiple part fastener 40, FIG. 5. The frame 30 has an elongated slot 41 in both portions 34, 35 receiving a shaft 42 of a cap screw 43 part of the multiple part fastener 40 that secures the frame 30 to an end wall 27' of the complementary housing 2. The cap screw 43 is threadably received in one end of an internally threaded sleeve 44 that serves as an adapter to threadably receive an externally threaded shaft 45 of a keying plug 46 of the multiple part fastener 40. The keying plug 46 has an enlarged head 47 with an offset key 48 that is offset from the axis of the shaft 45. The head 47 is rotatably received in a recess 49 of the header 22. The shaft 45 passes through an opening 50 through the header 22, and an aperture 51 through the printed circuit board 19. The multiple part fastener 40 retains together the frame 30, the complementary housing 2, the printed circuit board 19 and the header 22.

Each of the features and advantages of the invention contributes to the invention independently of the others.

We claim:

1. Polarizing and keying features comprise, a first connector provided with a polarizing structure and keying structure, a complementary housing provided with a receiving end for receiving the polarizing structure and the keying structure of the first connector, wherein the improvement comprises; the complementary housing is provided with a receiving end having multiple connector positions each defined by complementary polarizing means for receiving the polarizing structure of the first connector, the complementary housing includes a frame on the receiving end having complementary keying means aligned with the keying structure of the first connector and aligned with a single one of the multiple connector positions, a fastener connects the frame to the complementary housing, and an adapter connects to the fastener and to a mounting fastener that connects the complementary housing to a printed circuit board.

2. Polarizing and keying features, as recited in claim 1, wherein the improvement comprises; the frame is moveable along the receiving end to overlap the keying structure of the first connector and retain the first connector.

3. Polarizing and keying features as recited in claim 1, wherein the improvement comprises; the frame is moveable to lock the connector in position within the complementary housing.

4. Polarizing and keying features as recited in claim 1, wherein the improvement comprises; the frame includes an interchangeable portion with a combination of the keying means.

5. Polarizing and keying features as recited in claim 1, wherein the improvement comprises; the polarizing means defines multiple positions along the complementary housing for receiving the polarizing structure of the connector.

6. Polarizing and keying features as recited in claim 1, wherein the improvement comprises; the complementary housing is longer than the connector and has multiple positions for receiving the connector.

7. Polarizing and keying features comprising: multiple connectors having corresponding polarizing keys and corresponding combinations of keying structure, a complementary housing provided with a receiving end for receiving each of the multiple connectors, polarizing means of the receiving end for locating the polarizing keys of the multiple connectors along the receiving end, and interchangeable means for interchangeable mounting on the complementary housing of a first set of key receiving means for receiving the polarizing keys of the multiple connectors, and for interchangeable mounting on the complementary housing of a second set of key receiving means having corresponding combinations for receiving the keying structure of the multiple connectors, the interchangeable means being moveable on the complementary housing to a position overlapping the polarizing keys of the multiple connectors.

8. Polarizing and keying features as recited in claim 7, comprising: the multiple connectors being of different lengths, the receiving end being longer than each of the multiple connectors, and the polarizing means of the receiving end locating the polarizing structure of the multiple connectors of different lengths along the receiving end.

9. Polarizing and keying features as recited in claim 7, comprising: the second set of openings continuing to receive the keying structure of the multiple connectors with the interchangeable means in said position overlapping the polarizing keys.

10. Polarizing and keying features as recited in claim 7, comprising: the interchangeable means is a frame moveable along the receiving end.

11. Polarizing and keying features as recited in claim 7, comprising: the first set of key receiving means comprises multiple openings in the interchangeable means.

12. Polarizing and keying features as recited in claim 7, comprising: the second set of key receiving means comprises multiple openings in the interchangeable means.

* * * * *